US006908334B2

(12) United States Patent
Huang

(10) Patent No.: US 6,908,334 B2
(45) Date of Patent: Jun. 21, 2005

(54) INTERLINING PANEL STRUCTURE FOR MULTIPLE SOCKET

(76) Inventor: Pei-Chin Huang, P.O. Box No. 6-57, Junghe, Taipei 235, Taipei (TW)

( * ) Notice: Subject to any disclaimer, the term of this patent is extended or adjusted under 35 U.S.C. 154(b) by 0 days.

(21) Appl. No.: 10/610,557

(22) Filed: Jul. 2, 2003

(65) Prior Publication Data

US 2005/0003700 A1 Jan. 6, 2005

(51) Int. Cl.[7] ..... H01R 3/00
(52) U.S. Cl. ..... 439/491
(58) Field of Search ..... 439/490, 491, 439/488

(56) References Cited

U.S. PATENT DOCUMENTS 4,586,770 A * 5/1986 Poulin ..... 439/270
5,362,254 A * 11/1994 Siemon et al. ..... 439/536
5,775,935 A * 7/1998 Barna ..... 439/488
6,215,067 B1 * 4/2001 Chen ..... 174/66
6,718,674 B2 * 4/2004 Caveney et al. ..... 40/642.02

* cited by examiner

*Primary Examiner*—Phuong Dinh
(74) *Attorney, Agent, or Firm*—Troxell Law Office, PLLC

(57) ABSTRACT

An interlining structure for a multiple socket includes a housing, an indication object and a transparent plate. The housing is consisted of a cover and a base, and the cover is provided with a plurality of receptacles or even switches. The housing is further disposed with a dented embedding region for the transparent plate to cover thereon. A covered range of the transparent plate is placed with the indication object containing contents that are viewable from an exterior of the transparent plate. The indication object has related drawings and texts for indicating uses of the receptacles or switches, or other decorative and illustrative drawings and texts.

7 Claims, 7 Drawing Sheets

INTERLINING PANEL STRUCTURE FOR MULTIPLE SOCKET

BACKGROUND OF THE INVENTION (a) Field of the Invention

The invention relates to an interlining panel structure for a multiple socket, and more particularly, to an interlining panel structure having a dented embedding region disposed at a housing of the multiple socket so as to provide a transparent plate to cover thereon, and an indication object placed at a covered range of the transparent plate. Contents of the indication object are viewable from an exterior of the transparent plate. The indication object has related drawings and texts indicating uses of receptacles or switches of the multiple socket, or other decorative and illustrative drawings and texts.

(b) Description of the Prior Art

A multiple socket is formed by disposing a multiple sets of receptacles on a same housing, which then becomes a unit having multiple sets of receptacles. The unit is connected to a power supply via a relatively long power line in order to provide individual receptacles at the housing with power supply. An extension wire socket, for instance, is a type of multiple socket. In another type of multiple socket, a power pin is directly disposed at a housing thereof. Through the pin inserted in the power socket, each receptacle at the socket is provided with power supply. One example of this prior art is "Expandable Socket" disclosed by the Taiwan Patent Publication No. 380759.

Regardless of the type of multiple socket acquiring power supply using either a power line or an inserted pin, a main characteristic thereof is that multiple sets of receptacles are gathered at a same housing. FIGS. 8 and 9 of the U.S. Pat. No. 6,392,171 disclose another two different types of multi-sockets having the same characteristic. Since a multiple socket has multiple sets of receptacles and even multiple sets of switches, it is rather difficult to distinguish which plug belongs to which electric appliance when all the receptacles are inserted with plugs. Hence, pulling unintended plugs that further incurring accidental power cutoffs is considered as repeated occurrence. In the view of this issue, industrialists have proposed a design disclosed by the Taiwan Patent Publication No. 422423, wherein identification cards having distinct colors are provided at a fixed base and an upper cover thereof. The identification cards are disposed with insertion openings corresponding with the receptacles, and electric appliances connected are thus distinguished using the distinct colors. However, this structure still has drawbacks when put to use due to the following reasons:

1. This structure merely uses distinct colors as a measure for identification, but lacks a method for a user to remember electric appliances represented by individual colors. Especially in a long-term use, colors for corresponding electric appliances are likely forgotten. Therefore, the measure using colors is not at all practical.
2. According to this structure, identification is carried out through colors of the identification cards at the socket. However, when a plug of an adaptor having a larger volume is inserted into this structure, the identification cards are likely to be concealed by the adaptor plug. Consequently, a user cannot easily make appropriate identifications even in the presence of the identification cards having distinct colors.

Furthermore, when a multiple socket is being sold or given as a gift, a housing thereof is often attached with stickers containing texts indicating brand name, precautions for use, product features, name of the person giving the gift or events of remembrance. Nevertheless, these sticker labels are prone to cock up or peel off owing to temperature change or slackening of adhesive properties thereof, and thus again offering inadequate practicability. Suppose that the aforesaid texts, drawings and symbols are directly stamped or printed onto a surface of the multiple socket, although the texts, drawings and symbols are unlikely to fall off, production costs thereof are relatively much higher. In addition, this method hardly fulfills requirements of small quantities and diversified styles.

SUMMARY OF THE INVENTION

The primary object of the invention is to provide a multiple socket having clear indicative functions, wherein each set of receptacles or switches is labeled for indicating corresponding electric appliances, thereby enabling a user to appropriately turn on and off power supplies of the electric appliances using the multiple socket.

The secondary object of the invention is to provide a multiple socket having readily replaceable decorative drawings or illustrative texts, thereby offering the multiple socket with an easily changed appearance for complying with manufacturing requirements of having diversified styles and small quantities.

The other object of the invention is to provide a multiple socket having special visual effects, wherein a three-dimensional interlining effect formed by a transparent plate thereof offers the multiple socket with an enhanced texture.

To accomplish the aforesaid objects, an interlining panel structure according to the invention provides the multiple socket with indicative effects, and comprises a housing, an indication object and a transparent plate. The housing is consisted of a cover and a base. The cover is disposed with multiple sets of receptacles and even switches, and is also provided with a dented embedding region for a transparent plate to cover thereon. A covered range of the transparent plate is placed with a piece-like indication object. The indication object has drawings and texts predetermined, or written according to a user's needs. The drawings and texts may serve indicative purposes and are designed as different indicative symbols for corresponding with individual receptacles or switches, or may simply be decorations or descriptions. When viewing the indication object from an exterior of the transparent plate, marking, decorations and instructions are acquired from the drawings and texts on the indication objects.

DETAILED DESCRIPTION OF THE PREFERRED EMBODIMENTS

Various embodiments according to the invention are capable of accomplishing indicative and decorative purposes, and detailed descriptions shall be given with the accompanying drawings hereunder.

Figure 1:
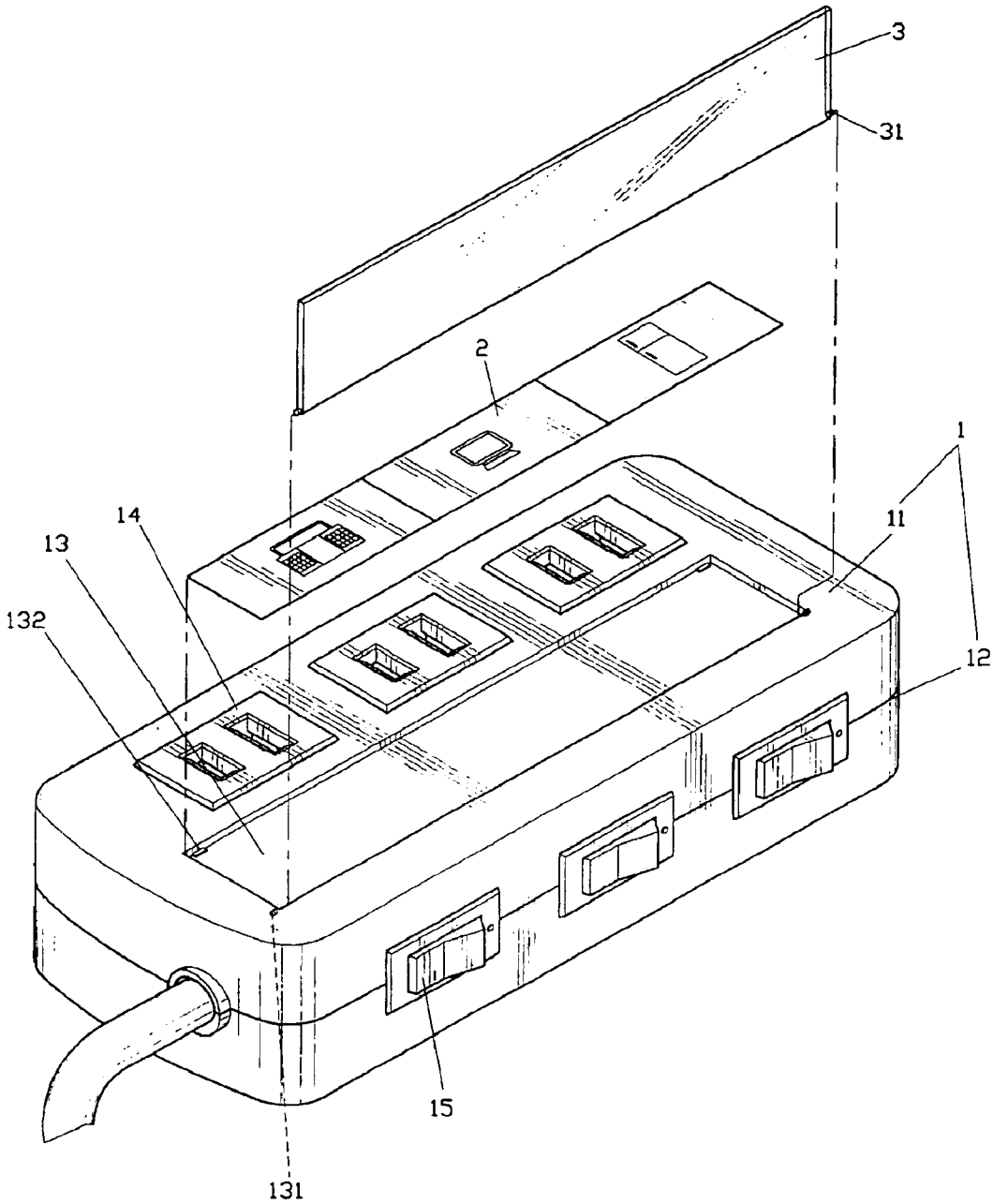
FIG. 1 shows a structural schematic view of a first embodiment according to the invention.

Referring to FIG. 1 showing a structure of a first embodiment, the invention comprises a housing 1, an indication object 2 and a transparent plate 3.

The housing 1 is consisted of a cover 11 and a base 12. The cover 11 is provided with a dented embedding region 13. The embedding region 13 is disposed with a pivotal opening 131 at two corners of one side thereof, respectively, and is formed with a projecting butting piece 132 at inner edges of the other side thereof, respectively. The housing 1 is further provided with corresponding receptacles 14 and switches 15.

The indication object 2 is provided according to a size of the embedding region 13, and is a thin slice made of an acrylic board, a piece of paper or a plastic board. The indication object 2 is further provided with drawings or texts corresponding to positions of the receptacles 14 and switches 15. In addition, the indication object 2 may also display drawings, brand name, illustrative texts or decorative graphics. The texts and drawings on the indication object 2 are provided in advance, or written and adhered by a user according to the user's needs.

The size of the transparent plate 3 approaches a size of the embedding region 13 at the cover 11. The transparent plate 3 is provided with a protruding flange 31 at two sides thereof in order to correspond with the pivotal openings 131 at the embedding region 13 of the housing 1, respectively.

Figure 2:
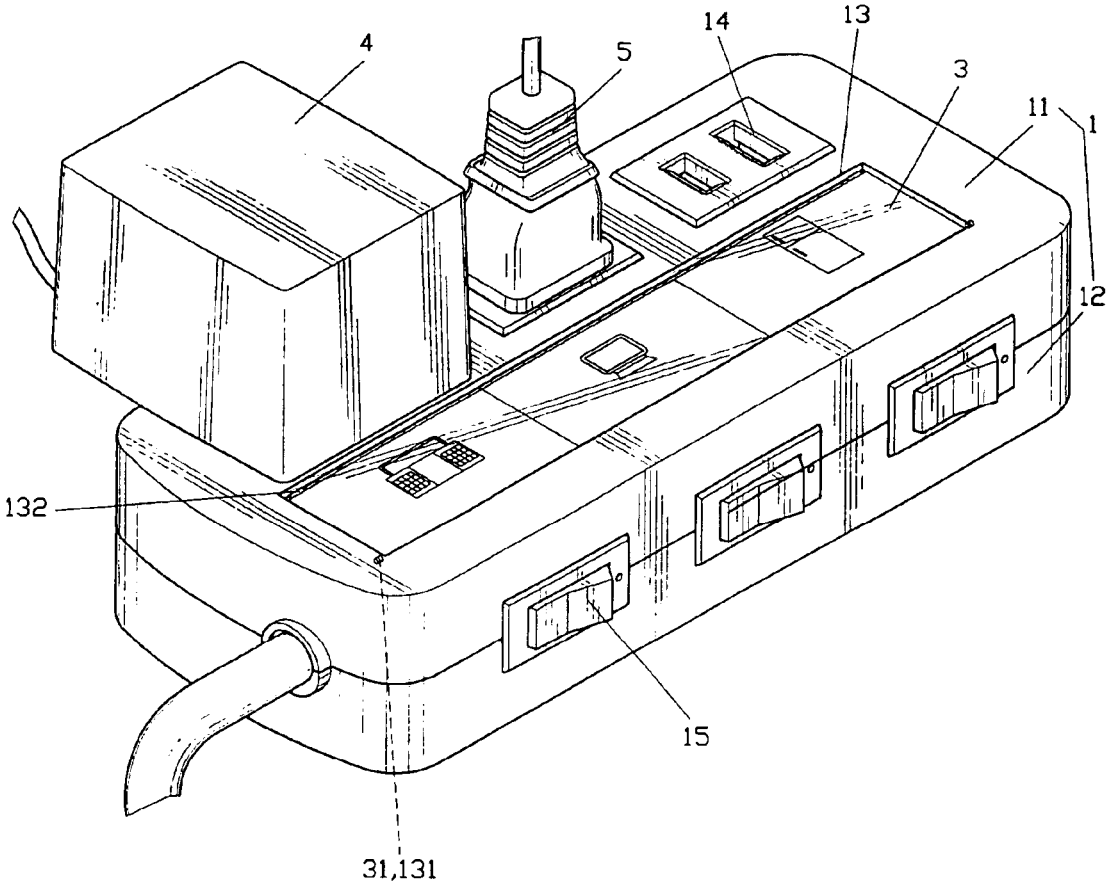
FIG. 2 shows an elevational schematic view of the first embodiment according to the invention.

During assembly, referring to FIG. 2, after completing the drawings and texts on the indication object 2, the indication object 2 is placed within the embedding region 13. The flange 31 of the transparent cover 3 are placed into the pivotal openings 131 of the housing 1, so as to correspondingly cover and buff the transparent cover 3 at the embedding region 13 by butting against the butting pieces 132. After assembly, the drawings and texts on the indication object 2 correspond with the individual receptacles 14 and switches 15, thereby clearly indicating uses of the receptacles 14 and switches 15 using the drawings and texts on the indication object 2 levelly placed within the embedding region 13. In this embodiment, the indication object 2 is placed at a side of the receptacles 14, and hence the indication object 2 remains apparent and unconcealed even if an adaptor plug 4 having a larger volume or a large plug 5 is inserted into the receptacles 14.

Figure 3:
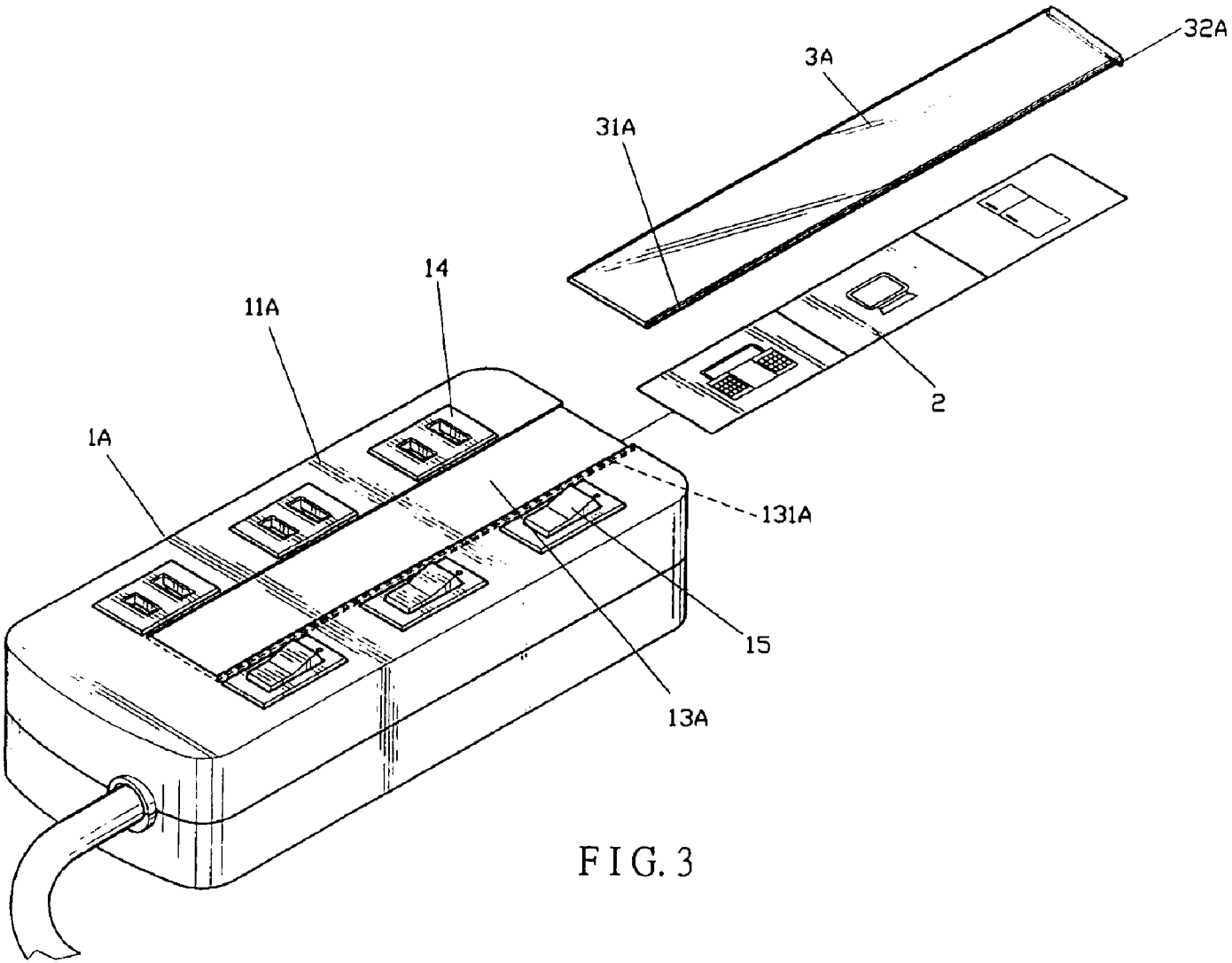
FIG. 3 shows a structural schematic view of a second embodiment according to the invention.

Referring to FIG. 3 showing a second embodiment according to the invention, a housing 1A is provided with an embedding region 13A at a cover 11A and between the receptacles 14 and switches 15. The embedding region 13A is disposed with a wedge groove 131A at two corresponding inner edges thereof, respectively. Two sides of a transparent plate 3A are similarly formed with a wedge portion 31A for corresponding with the wedge grooves 131A, respectively. One end portion of the transparent plate 3A is additionally provided with a vertical baffle portion 32A. The wedge portions 31A of the transparent plate 3A are slid and wedged at the corresponding wedge grooves 131A, and an exit of the end portion is blocked by the baffle portion 32A for preventing accidental falling off of the indication object 2. The indication object 2 is then placed at the embedding region 13A for offering same indicative purposes.

Figure 4:
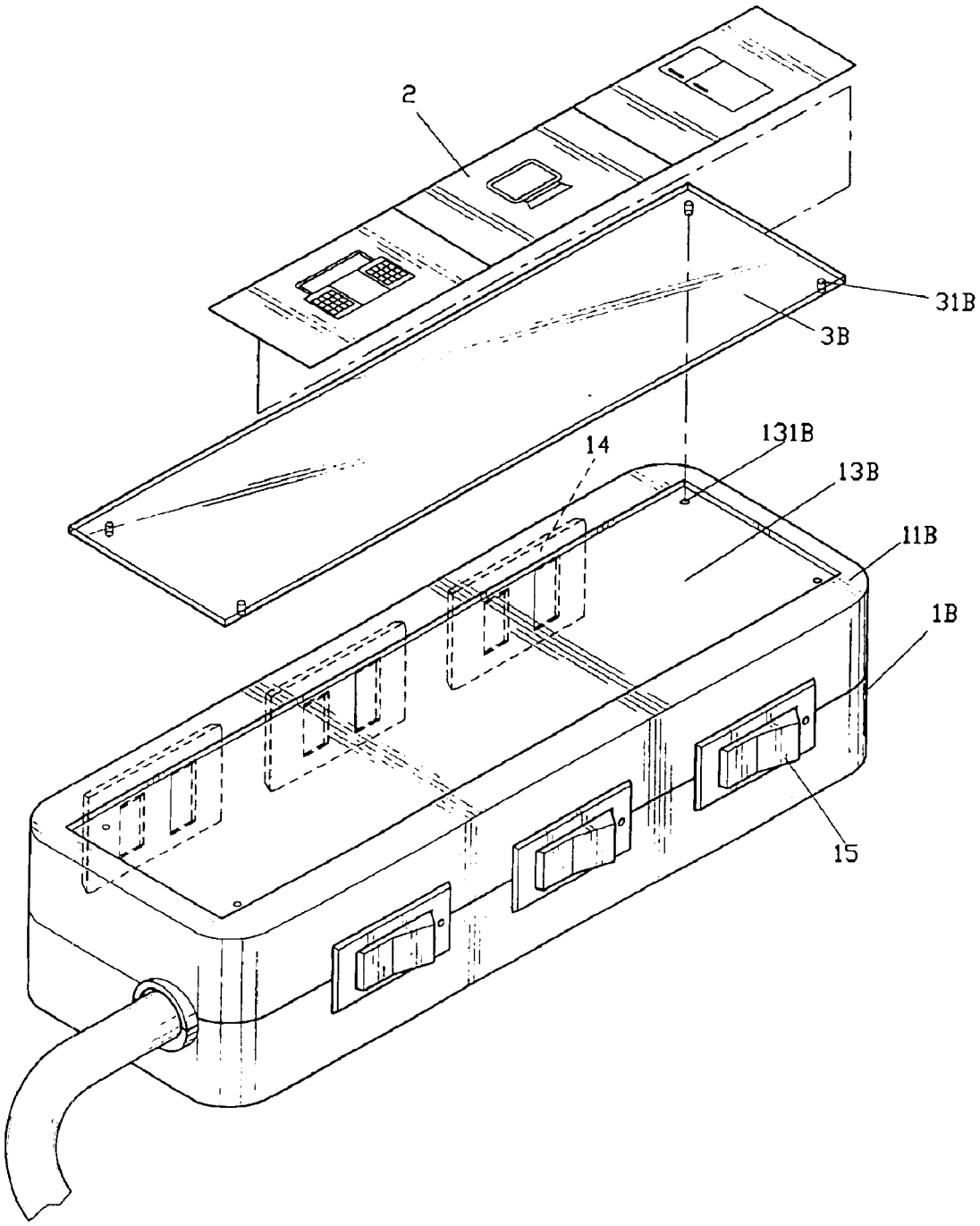
FIG. 4 shows a structural schematic view of a third embodiment according to the invention.

Referring to FIG. 4 showing a third embodiment according to the invention, a cover 11B of a housing 1B is provided with an embedding region 13B having positioning holes 131B. A transparent plate 3B is a board, and has a lower side thereof disposed with positioning pillars 24B for corresponding with the positioning holes 131B at the embedding regions 13B. For assembly, the indication object 2 is placed within the embedding region 13B, and the positioning pillars 31B at the lower side of the transparent plate 3B are inserted into and positioned at the positioning holes 131B at the embedding region 13B.

Figure 5:
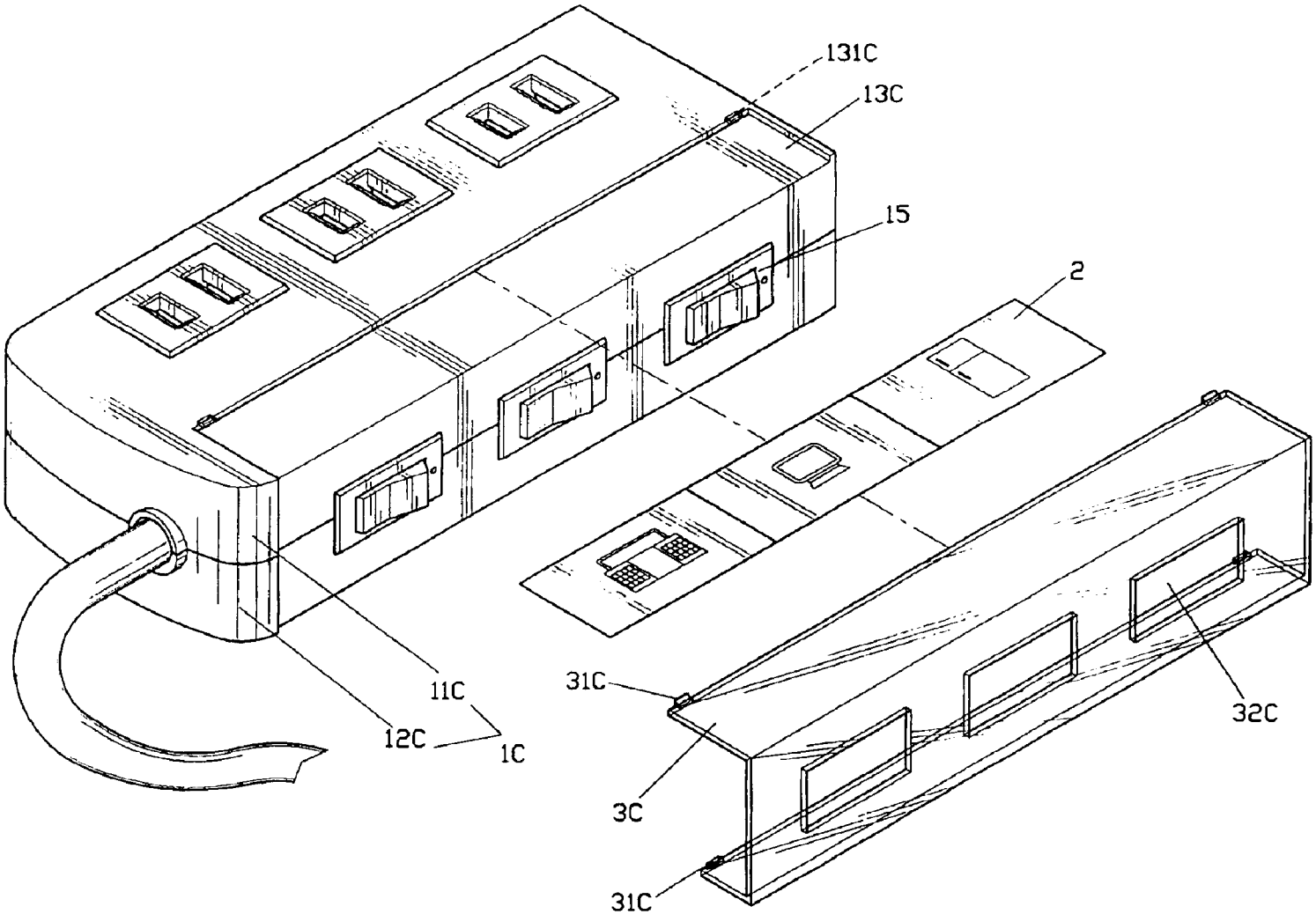
FIG. 5 shows a structural schematic view of a fourth embodiment according to the invention.

Referring to FIG. 5 showing a fourth embodiment according to the invention, an embedding region 13C of a housing 1C is extended from a top horizontal side plane of a cover 11C, across a vertical side plane of the cover 11C and a base 12C, and to a bottom horizontal side plane of the base 12C. Edges of the top and bottom horizontal planes of the embedding region 13C are disposed with fastening openings 131C. A transparent plate 3C corresponding to the embedding region 13C is formed as a U-shaped board. Horizontal edges of the transparent plate 3C are disposed with tenons 31C for corresponding with the fastening openings 135C, and a vertical plane of the transparent plate 3C is disposed with accommodating apertures 32C according to positions, sizes and number of the switches 15. The indication object 2 is first placed within the embedding region 13C, and the transparent plate 3C is embedded and covered at the embedding region 13C at the housing 1C, thereby arranging the indication object 2 at the housing 1C.

Figure 6:
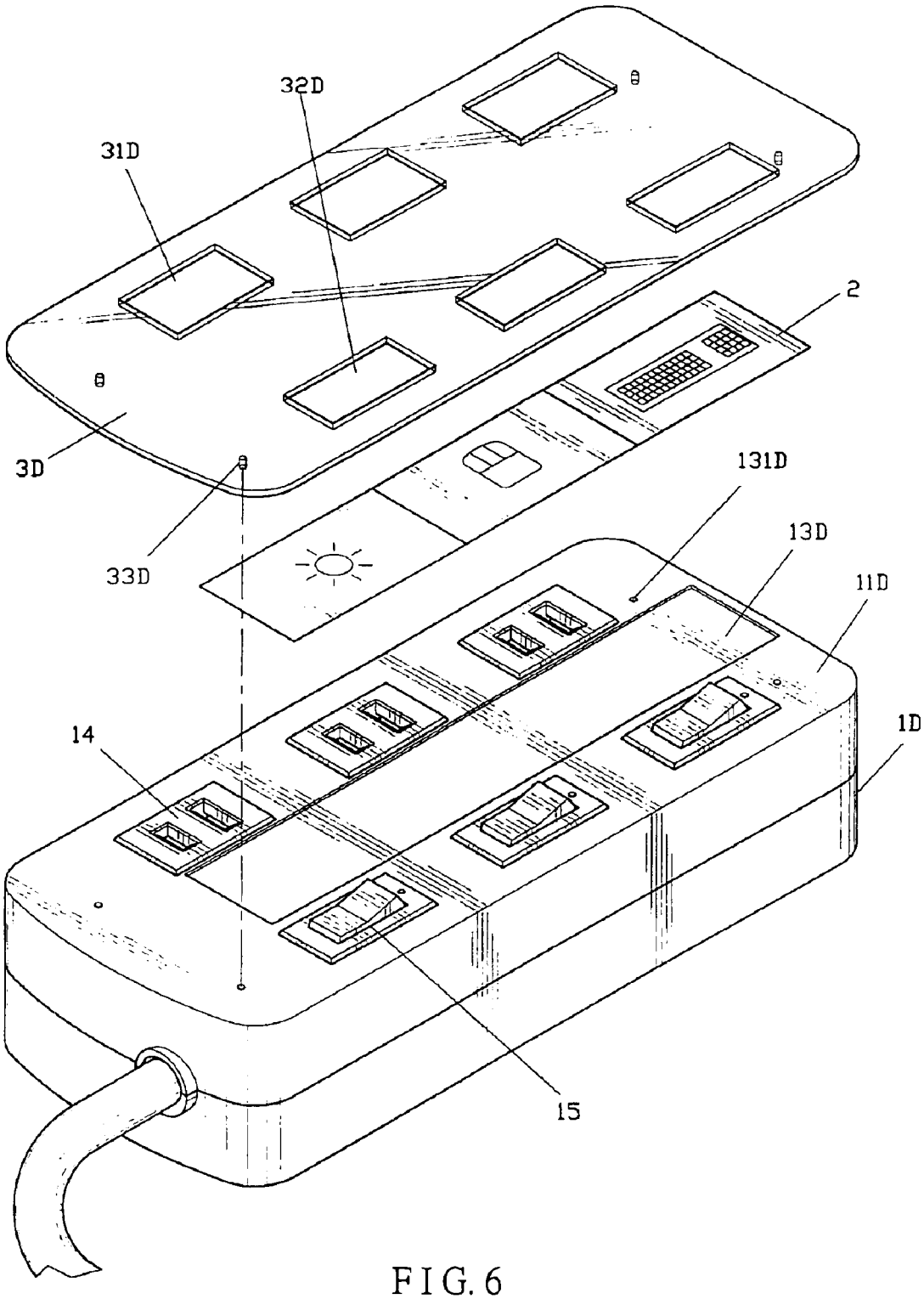
FIG. 6 shows a structural schematic view of a fifth embodiment according to the invention.

Referring to FIG. 6 showing a fifth embodiment according to the invention, a cover 11D of the housing 1D is provided with an embedding region 13D corresponding to the size of the indication object 2, and the housing 1D is provided with positioning holes 131D. A transparent plate 3D is designed as having a large area covering the receptacles 14 and the switches 15. The transparent plate 3D is further disposed with accommodating apertures 31D and 32D corresponding to sizes and number of the receptacles 14 and switches 15, and a lower side of the transparent plate 3C is provided with protruding positioning pillars 33D. The indication object 2 is placed within the embedding region 13D, and the positioning pillars 33D at the transparent plate 3D are inserted into the corresponding positioning holes 131D at the housing 1D, so as to arrange the receptacles 14 and the switches 15 in the accommodating apertures 31D and 32D.

Figure 7:
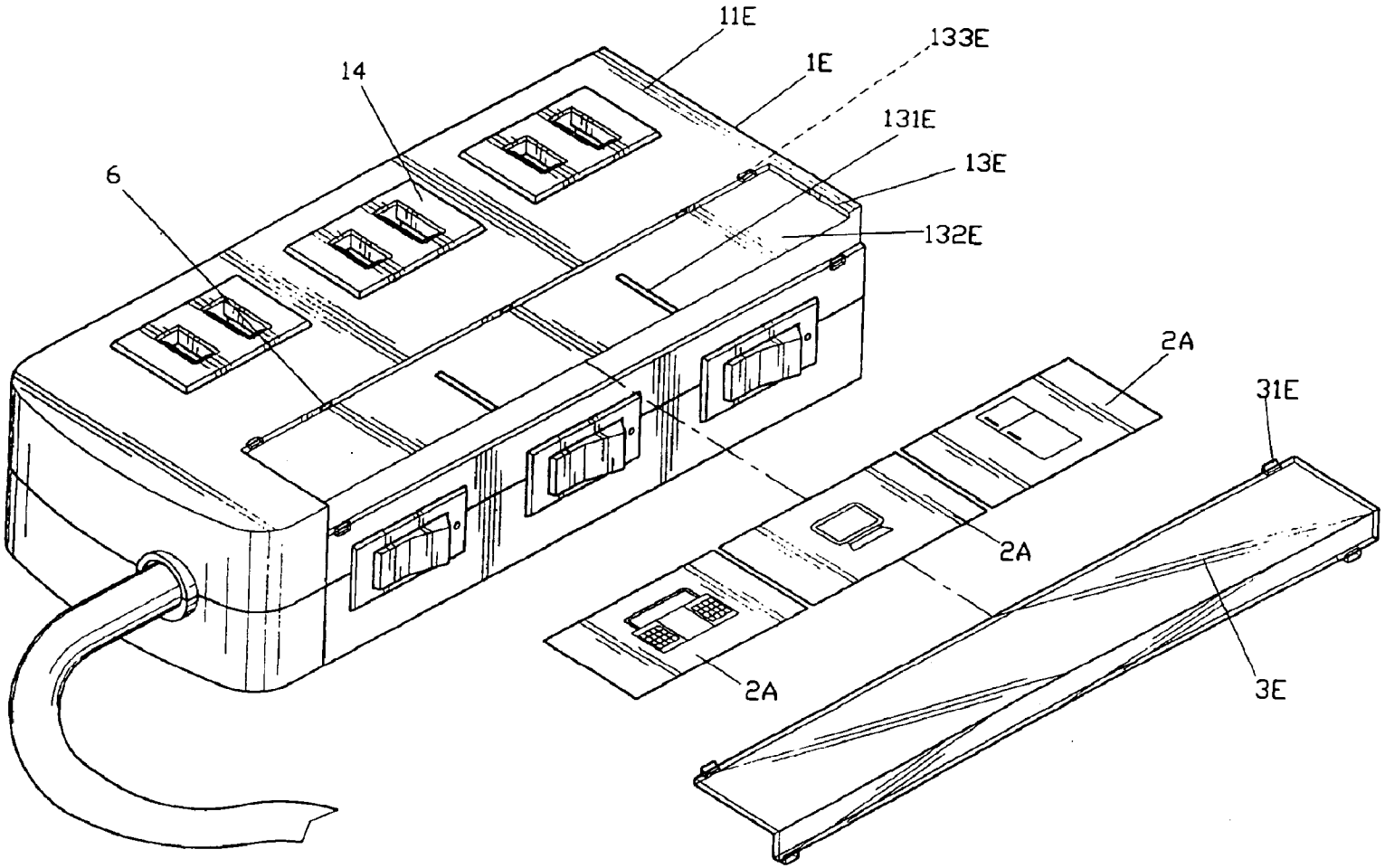
FIG. 7 shows a structural schematic view of a sixth embodiment according to the invention.

Referring to FIG. 7 showing a sixth embodiment according to the invention, a cover 11D of the housing 1D is provided with an embedding region 13E, which is divided into a plurality of partitions 132E corresponding to positions of the receptacles 14 using baffle strips 131E, and each partition 132E is placed with a lamp 6 connected with internal circuits. Fastening openings 133E are disposed at embedding region edges where the embedding region 13E comes into contact with edges of a transparent plate 3E. The edges of the transparent plate 3E are disposed with tenons 31E for corresponding with the fastening openings 133E at the embedding region 13E. In addition, the aforesaid indication object 2 in form of a single slice is represented by a plurality of independent indication object 2A corresponding to sizes of the partitions 132E in this embodiment. During assembly, the indication objects 2A are inserted into the partitions 132E in sequence, and the embedding region 13E is placed with the corresponding transparent plate 3E for covering all the indication objects 2A within the partitions 132E. Using the lamps 18E provided in each of the partitions 131E, especially in dark surroundings, the drawings and texts on the indication object 2 are clearly displayed using illumination effects of the lamps 6 upon the indication object 2.

In the embodiment disclosed in FIG. 7, the lamps 6 are provided at the embedding region 13E for assisting illumination of the indication object 2. This illumination method may also be adopted in other aforesaid embodiments. Or, the lamps 6 may also project light beams onto the transparent plate 3E from different directions for providing decorative effects with the coordination of the transparent plate 3E.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multiple socket assembly comprising:

a) a housing having a dented embedding region;

b) a plurality of receptacles located in the housing;

c) a plurality of switches located in the housing, each of the plurality of receptacles corresponding with one of the plurality of switches;

d) an identification object removably inserted into the dented embedding region; and e) a transparent plate pivotally connected to the dented embedding region and movable between open and closed positions, wherein, when the transparent plate is in the open position, the identification object is removable from the dented embedding region, and, when the transparent plate is in the closed position, the identification object is covered by the transparent plate.

2. The multiple socket assembly according to claim 1, wherein the dented embedding region having a projecting butting piece located on a first side thereof and two pivotal openings located on a second side thereof, one of the two pivotal openings is located on each of two opposing ends of the second side, the transparent plate having two protruding flanges, each of the two protruding flanges is located on one of two opposing ends of a first side thereof, one of the two protruding flanges being inserted into each of the two pivotal openings.

3. The multiple socket assembly according to claim 2, wherein, in the closed position, a second side of the transparent plate engaging the projecting butting piece of the dented embedding region.

4. The multiple socket assembly according to claim 1, wherein the dented embedding region having lamps connected with internal circuits.

5. The multiple socket assembly according to claim 1, wherein the indication object having a plurality of identifiers, each of the plurality of identifiers corresponding with one of the plurality of receptacles.

6. The multiple socket assembly according to claim 1, wherein the indication object is a plurality of individual pieces.

7. The multiple socket assembly according to claim 1, wherein the indication object having a plurality of identifiers, each of the plurality of identifiers is selected from a group consisting of drawings, text, and a combination thereof.

* * * * *